United States Patent [19]

Cohen et al.

[11] Patent Number: 4,551,783

[45] Date of Patent: Nov. 5, 1985

[54] HEEL GROUNDING STRAP

[75] Inventors: Lenard Cohen, Brighton; Michael E. Gordon, Wayland, both of Mass.

[73] Assignee: Plastic Systems, Inc., Marlboro, Mass.

[21] Appl. No.: 662,785

[22] Filed: Oct. 19, 1984

[51] Int. Cl.[4] ..... H05F 3/02

[52] U.S. Cl. ..... 361/223; 361/224

[58] Field of Search ..... 361/223, 224

[56] References Cited

U.S. PATENT DOCUMENTS

| | | | |
|---|---|---|---|
| 1,940,491 | 12/1933 | Freitag | 175/265 |
| 2,287,744 | 6/1942 | Monahan | 175/264 |
| 2,785,344 | 3/1957 | Hines | 361/223 |
| 3,015,754 | 1/1962 | Legge | 361/223 |
| 3,359,456 | 12/1967 | Woskin | 317/1 |
| 3,379,932 | 4/1968 | Legge | 317/2 |
| 3,459,997 | 8/1969 | Legge | 317/2 |
| 3,596,134 | 7/1971 | Burke | 317/2 |
| 3,737,723 | 6/1973 | Kanor | 317/2 |
| 3,798,503 | 3/1974 | Larsh | 317/2 |
| 3,857,397 | 12/1974 | Brosseau | 128/384 |
| 3,912,973 | 10/1975 | Young | 317/2 |

FOREIGN PATENT DOCUMENTS 791199 2/1958 United Kingdom .

OTHER PUBLICATIONS

Legge Conductive Products, advertising brochure, pp. 1–2, (Date of publication unknown).

Effective Static Control with the Legge System, advertising brochure of Walter G. Legge Co., Inc., pp. 2–4, (Date of publication unknown).

Velostat 3M, advertising brochure of Static Control Systems/3M, pp. 1–2, (Date of publication unknown).

*Primary Examiner*—Reinhard J. Eisenzopf

[57] ABSTRACT

A grounding device for dissipating electrostatic voltages from the body of a wearer comprises: a pair of grounding straps of equal length joined together at right angles at their ends; a pair of fastener straps extending from the grounding strap ends at about 45°; and an elongated tongue of conductive elastomer having a resistivity of about $1 \times 10^6$ ohm per square, the tongue being connected to one of the grounding strap ends and the fastener at such end; the length of the grounding straps being selected such that with one strap against a shoe counter, the other extends under the heel of the shoe.

6 Claims, 3 Drawing Figures

FIG 1
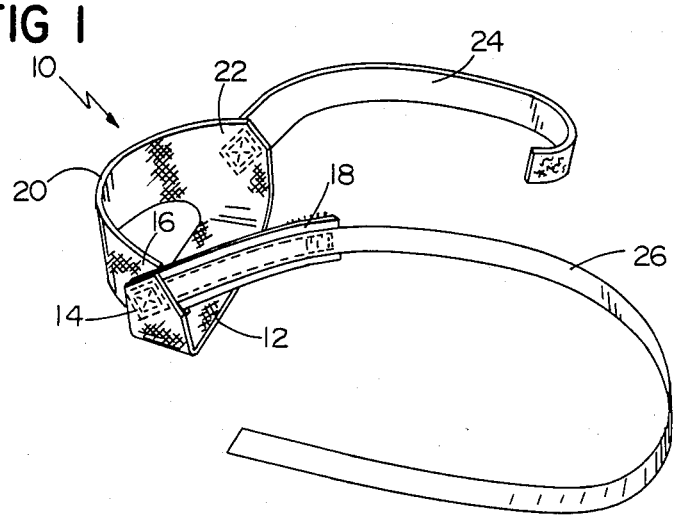
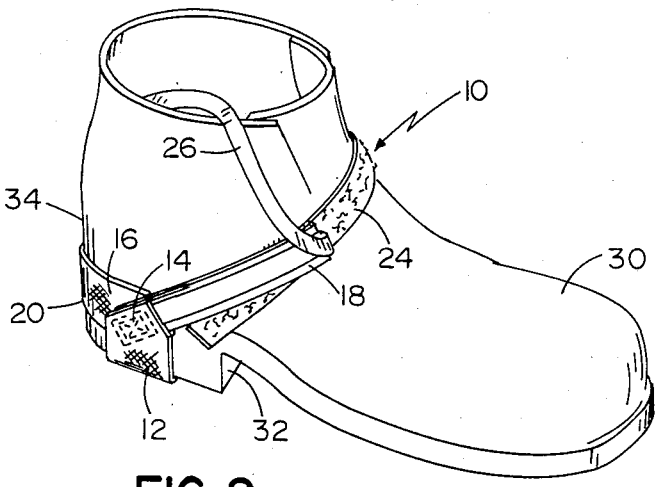
FIG 2
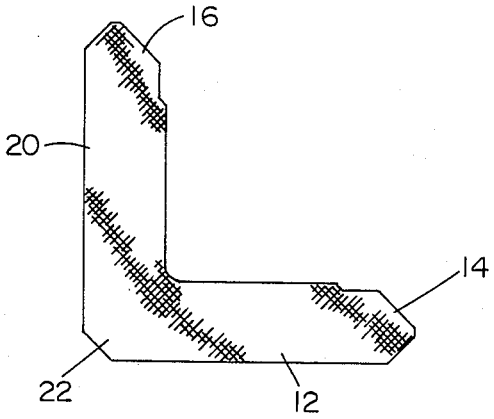
FIG 3

HEEL GROUNDING STRAP

This invention relates to grounding devices for dissipating electrostatic voltages on the body of the wearer to conductive flooring.

Grounding devices known in the prior art are often worn at the instep of the wearer's shoe and typically are provided with a single conductive grounding strap. Unfortunately such straps may not provide grounding contact with all shoe types. Such a device is illustrated, for example in U.S. Pat. No. 3,379,932. Another type grounding device, illustrated in U.S. Pat. No. 3,459,997 comprises a conductive strap extending legthwise under the sole of the wearer's shoe; such straps are not adapted to fit all shoe types and utilize extensive material. Still another type device known in the art is a conductive adhesive strap which extends down one side of the shoe and is adhesively secured under the heel of the shoe; the strap is discarded after usage and adhesion to the heel may depend on the cleanliness of the heel surface.

It is an object of the present invention to provide a grounding device which is adapted to fit and provide reliable grounding with most shoe types. It is another object to provide a device which has a pair of grounding straps which can be interchanged when one of the straps exhibits wear.

In general the invention features a grounding device comprising a pair of grounding straps of conductive elastomer material. The straps are joined together at right angles at their ends and are of equal length selected such that with one strap extending about a shoe counter the other extends under the shoe heel. A pair of fastener straps are connected to the ends of the grounding straps and a elongated conductor is connected to one end of the grounding straps. In a preferred embodiment the grounding straps are about 6 inches long and are integral at one end. Also in a preferred embodiment the conductor comprises an elongated tongue of a conductive elastomer and has a resistivity of at least about $1\times10^6$ ohm per square. In the preferred embodiment the tongue is connected to one fastening strap and the fastening strap and the tongue extend from the grounding strap ends at an angle of about 45°.

Other objects, features and advantages of this invention will apopear to those skilled in the art from the following detailed description of an embodiment thereof, taken together with the accompanying drawings in which:

FIG. 1 is an isometric view of the grounding device;

FIG. 2 is an isometric view of the grounding device attached to a shoe or boot; and FIG. 3 is a plan view of the die cut grounding strap portions of the grounding device.

As illustrated in FIG. 1, the grounding device 10 comprises a pair of conductive grounding straps 12, 20 of equal length, approximately 6 inches, connected together at right angles at their ends, respectively 14, 16, 22, to form a conductive cup shaped member. Velcro fastening straps 18, 24 are connected to the ends 14, 16, 22 of grounding straps 12, 20, extending therefrom at an angle of about 45°. Connected to one of the fastening straps 18 and also joined to ends 14, 16 of the grounding straps is an elongated, approximately 21 inches, conductor i.e., conductive tongue or band 26.

In a preferred embodiment, the grounding straps 12, 20 are of integral one piece construction at one end 22 and the other ends 14, 16 are sewn or otherwise permanently fastened together with fastening strap 18 and tongue 24 secured between the ends 14, 16. Grounding straps 12, 20 preferably also have a textured surface embossed therein on both sides.

The length of grounding straps 12, 20 is selected such that in use, as illustrated in FIG. 2, one strap portion 20 will fit under the heel 32 of a shoe 30 while the other portion extends about the shoe counter 34. Advantageously, heel height, as with the high heel boots or with flat shoes, does not limit the utility of the grounding device 10. Elongated tongue 26 further has a length which permits use even with moderately high boot tops. Because grounding strap 12, 20 are of equal length, they can be worn interchangeably under the heel if, for example, one portion becomes worn or contaminated, thus, extending the life of grounding device 10. On the other hand, the simple design of the device minimizes the material utilized.

In manufacture, the grounding straps 12, 20 are die cut as a single piece from a sheet of conductive material, straps 12, 20 having a generally L shape integrally connected at one end 22, as illustrated in FIG. 3. The material from which grounding straps 12, 20 are cut comprises a fabric coated with a conductive elastomer such as neoprene filled with approximately 30% carbon black. Tongue 24 is also cut from fabric coated with a conductive elastomer such as neoprene filled with approximately 20% carbon black. The lower carbon content of tongue 24 is selected, for the safety of the wearer, to provide a resistivity of about at least $1\times10^6$ ohm per square.

In use, grounding straps 12, 20 are placed under the heel 32 and around the counter of a shoe 34. Velcro fastener straps 18, 24 are then fastened about the shoe to hold the grounding straps snugly against the shoe. Tongue 26 is extended inside the shoe 30 and may be trimmed if too long. If one grounding strap becomes worn, the other strap portion may thereafter be worn under the heel.

Other embodiments of this invention will occur to those skilled in the art which are within the scope of the following claims:

What is claimed is:

1. A grounding device comprising: a pair of straps connected together at right angles at their ends; fastener means connected to said ends of said straps; and an elongated conductor connected to one end of said straps; said grounding device characterized in that said straps each comprise a conductive elastomer, each strap thereby comprises a grounding strap, said grounding straps are of substantially equal length, and the length of said grounding straps is such that with either grounding strap extending about a shoe counter, the other grounding strap will be positioned under the heel of said shoe.

2. The grounding device claimed in claim 1 further characterized in that said grounding straps comprise a single piece integrally connected at one end.

3. The grounding device claimed in claim 1 further characterized in that said grounding straps have a length of about 6 inches.

4. The grounding device claimed in claim 1 further characterized in that said conductor comprises a tongue of conductive elastomer having a reistivity of at least $1\times10^6$ ohms per square.

5. The grounding device claimed in claim 4 further characterized in that said tongue is connected to one of said fastener means.

6. The grounding device claimed in claim 5 further characterized in that said fastener means comprise a pair of fasteners straps and said fastener straps and said tongue extend from said grounding strap ends at an angle of about 45°.

* * * * *

UNITED STATES PATENT AND TRADEMARK OFFICE

CERTIFICATE OF CORRECTION

PATENT NO. : 4,551,783

DATED : November 5, 1985

INVENTOR(S) : Lenard Cohen, et al.

It is certified that error appears in the above-identified patent and that said Letters Patent are hereby corrected as shown below:

Column 1, line 45, "apopear" is corrected to read --appear--;

Column 1, line 68, and Column 2, lines 23 and 26, "24" is corrected to read --26--;

Column 2, line 4, "20" is corrected to read --12--.

Signed and Sealed this

*Eighteenth* Day of *February 1986*

[SEAL]

*Attest:*

DONALD J. QUIGG

*Attesting Officer*

*Commissioner of Patents and Trademarks*